US008254821B2

(12) United States Patent
Kuribayashi

(10) Patent No.: US 8,254,821 B2
(45) Date of Patent: Aug. 28, 2012

(54) CLEANING APPARATUS, IMAGE FORMING APPARATUS INCLUDING THE SAME, AND PROCESS CARTRIDGE INCLUDING THE SAME

(75) Inventor: Natsuki Kuribayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 12/414,926

(22) Filed: Mar. 31, 2009

(65) Prior Publication Data

US 2009/0252544 A1 Oct. 8, 2009

(30) Foreign Application Priority Data

Apr. 2, 2008 (JP) ..... 2008-096364
Dec. 26, 2008 (JP) ..... 2008-333732

(51) Int. Cl.
*G03G 21/00* (2006.01)

(52) U.S. Cl. ..... 399/350

(58) Field of Classification Search ..... 399/350
See application file for complete search history.

(56) References Cited

U.S. PATENT DOCUMENTS

| | | | | |
|---|---|---|---|---|
| 3,851,965 | A * | 12/1974 | Furuichi et al. | 399/357 |
| 5,168,309 | A * | 12/1992 | Adachi et al. | 399/174 |
| 2002/0021923 | A1* | 2/2002 | Sato et al. | 399/350 |
| 2005/0100375 | A1* | 5/2005 | Naruse et al. | 399/350 |
| 2008/0317487 | A1* | 12/2008 | Murakami | 399/45 |

FOREIGN PATENT DOCUMENTS

| | | | |
|---|---|---|---|
| JP | 58080682 | A * | 5/1983 |
| JP | 5-119686 | | 5/1993 |
| JP | 06332350 | A * | 12/1994 |
| JP | 9-292722 | | 11/1997 |
| JP | 2000-330441 | | 11/2000 |
| JP | 2000321945 | A * | 11/2000 |
| JP | 2001-66963 | | 3/2001 |
| JP | 2005-99125 | | 4/2005 |

OTHER PUBLICATIONS

Machine Translation of JP 2000321945.*
English Abstract of JP 58080682.*

* cited by examiner

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A cleaning apparatus includes a blade to remove one or more toner particles remaining on a photosensitive body of an electrophotographic type image forming apparatus. The toner particles have a mean particle diameter D and a standard deviation σ of a particle size distribution. The blade is arranged on the photosensitive body to satisfy a following condition.

$$\mu \leq \frac{\sin\theta}{1+\cos\theta},$$

When an imaginary sphere having a diameter of (D−σ) contacts the photosensitive body and the blade, θ is an angle defined by a tangent line at a contact point between the sphere and the photosensitive body and a tangent line at a contact point between the sphere and the blade, sandwiching the sphere therebetween. μ is a smaller friction coefficient of a friction coefficient between the toner particle and the photosensitive body and a friction coefficient between the toner particle and the blade.

14 Claims, 8 Drawing Sheets

| ANGLE $\theta_0$ BETWEEN TANGENT LINES AT INITIAL CONTACT | ANALYSIS RESULT | RESULT BY DEM CALCULATION |
|---|---|---|
| 15° | $\mu_C = 0.132$ | $0.13 < \mu_C < 0.14$ |
| 30° | $\mu_C = 0.268$ | $0.26 < \mu_C < 0.27$ |
| 45° | $\mu_C = 0.414$ | $0.41 < \mu_C < 0.42$ |

CLEANING APPARATUS, IMAGE FORMING APPARATUS INCLUDING THE SAME, AND PROCESS CARTRIDGE INCLUDING THE SAME

BACKGROUND OF THE INVENTION

1. Field of the Invention

The present invention generally relates to a cleaning apparatus, an image forming apparatus including the cleaning apparatus, and a process cartridge including the cleaning apparatus.

2. Description of the Related Art

In these years, there is demand for electrophotographic type image forming apparatuses such as electrophotographic copiers and electrophotographic printers to be smaller in size and lower in cost to efficiently use office environments. Further, there is demand for the electrophotographic type image forming apparatuses to provide higher image quality according to a need to output image data with higher quality, and to realize a longer service life and higher durability in view of economic efficiency and protection of environmental resources.

To provide higher image quality by an electrophotographic type image forming apparatus (simply referred to as an image forming apparatus when not particularly described, hereinafter), a cleaning apparatus to remove toner remaining on a photosensitive body is known. A toner image is formed on a photosensitive body, which is then transferred onto an intermediate transfer medium and a recording medium. However, a part of the toner sometimes remains on the photosensitive body. Toner images are repeatedly formed on the photosensitive body to be transferred onto the intermediate transfer medium and the like. When a part of the toner remains on the photosensitive body, this toner becomes a blot to degrade image quality of the next image formed. Therefore, in many cases, image forming apparatuses have cleaning apparatuses to remove toner remaining on photosensitive bodies.

As a cleaning method of the cleaning apparatus, a cleaning method using a brush and a cleaning method using a blade are widely known. The cleaning method using a blade, by which toner remaining on a photosensitive body is removed by using a small and inexpensive rubber blade, is widely employed in view of cost, the service life of the photosensitive body, and the like.

For example, Patent Documents 1 through 4 disclose techniques to provide favorable cleaning blades. According to Patent Documents 1 through 3, by specifying conditions such as elasticity, a shape, a pressing method, and an applied pressure of a blade member, an effect to remove toner remaining on a photosensitive body is realized. Patent Document 4 discloses a cleaning method to improve removal efficiency of remaining toner by causing a blade to vibrate.

On the other hand, since it became known that it is more effective to use small spherical toner particles for image formation to provide higher image quality, the small spherical toner particles have been used in many electrophotographic type image forming apparatuses. However, there is arising a problem in that it is difficult to remove the spherical toner particles remaining on a photosensitive body. Therefore, a blade with a better removal property of the remaining toner is required.

At a front end part of a blade of a conventional blade type cleaning apparatus, a rubber blade is pressed onto a surface of a photosensitive body as shown in FIG. 7. When the surface of the photosensitive body moves, the front end part of the blade is deformed, being dragged by the movement of the surface of the photosensitive body. Thus, a wedge-shaped space is formed between the front end part of the blade and the surface of the photosensitive body. Such a blade has a sufficient cleaning effect with respect to a ground toner with a low sphericity, which is easily stopped in this space. However, it is difficult to sufficiently remove spherical toner particles with a small particle diameter remaining on the surface of the photosensitive body since the spherical toner particles with a small particle diameter can roll and can go into an innermost part of the wedge-shaped space, and even slip through a contact part between the blade and the surface of the photosensitive body.

Patent Document 5 discloses a cleaning method of removing the spherical toner particles. By the cleaning method of Patent Document 5, there is a predetermined relationship set among the friction coefficient between the front end part of a blade and toner, the friction coefficient between a surface of a photosensitive body and the toner, an adhering force between the toner and the surface of the photosensitive body, a pressuring force of the blade against the toner, and a pressuring angle between the front end part of the blade and the surface of the photosensitive body. According to this relationship disclosed in Patent Document 5, remaining spherical toner particles adhering on the surface of the photosensitive body can be efficiently removed.

Patent Document 1: Japanese Patent Application Publication No. 9-292722

Patent Document 2: Japanese Patent Application Publication No. 5-119686

Patent Document 3: Japanese Patent Application Publication No. 2000-330441

Patent Document 4: Japanese Patent Application Publication No. 2001-66963

Patent Document 5: Japanese Patent Application Publication No. 2005-99125

According to the cleaning method disclosed in Patent Document 5, the spherical toner particles remaining on the surface of the photosensitive body can be removed. However, since quite a lot of parameters are required to be measured or controlled, it is not easy to achieve favorable conditions. Further, according to this cleaning method, an effect of rolling of the spherical toner particles which are stopped between the surface of the photosensitive body and the front end part of the blade is not taken into sufficient consideration. Therefore, unnecessarily strict conditions may be set for removing the remaining toner. When a conventional ground toner having low sphericity is used, an effect to stop the toner by utilizing the effect of rolling may be low. However, when the spherical toner particles roll on the surface of the photosensitive body, it is considered less likely that the spherical toner particles slip through a space between the blade and the surface of the photosensitive body.

SUMMARY OF THE INVENTION

In view of the above-described problems, it is an object of at least one embodiment of the present invention to provide a cleaning apparatus having a blade capable of effectively removing toner including even spherical toner particles remaining on a surface of a photosensitive body, an image forming apparatus using this cleaning apparatus, and a process cartridge for an image forming apparatus, containing the cleaning apparatus.

The inventors made the following invention in order to solve the above-described problems.

According to one aspect of the present invention, a cleaning apparatus includes a photosensitive body of an electrophotographic type image forming apparatus, which has a surface; and a blade configured to remove one or more toner particles remaining on the surface of the photosensitive body. One or more of the toner particles have a mean particle diameter D and a standard deviation σ of a particle size distribution, and a front end of the blade is arranged on the surface of the photosensitive body so as to satisfy a condition represented as:

$$\mu \leq \frac{\sin\theta}{1+\cos\theta},$$

when an imaginary sphere having a diameter of (D−τ) contacts the surface of the photosensitive body and the blade at the same time, θ is an angle defined by a first tangent line at a contact point between the sphere and the surface of the photosensitive body and a second tangent line at a contact point between the sphere and the blade, with the sphere sandwiched by said first and second tangent lines. μ is a smaller friction coefficient of a friction coefficient between said one or more toner particles and the surface of the photosensitive body and a friction coefficient between said one or more toner particles and the blade.

According to another aspect of the present invention, a cleaning apparatus includes a photosensitive body of an electrophotographic type image forming apparatus, which has a surface; a base substrate having a surface and formed in a cylindrical shape which can rotate about a shaft; and plural blades formed over the surface of the base substrate and configured to remove one or more toner particles remaining on the surface of the photosensitive body. One or more of the toner particles have a mean particle diameter D and a standard deviation σ of a particle size distribution. One or more front ends of the blades are arranged on the surface of the photosensitive body so as to satisfy a condition represented as:

$$\mu \leq \frac{\sin\theta}{1+\cos\theta},$$

when an imaginary sphere having a diameter of (D−σ) contacts the surface of the photosensitive body and the blade at the same time, θ is an angle defined by a first tangent line at a contact point between the sphere and the surface of the photosensitive body and a second tangent line at a contact point between the sphere and the blade, with the sphere sandwiched by said first and second tangent lines. μ is a smaller friction coefficient of a friction coefficient between said one or more toner particles and the surface of the photosensitive body and a friction coefficient between said one or more toner particles and the blade.

BRIEF DESCRIPTION OF THE DRAWINGS

FIG. 9A is a chart showing results of calculating conditions (maximum friction coefficients μc) with which a spherical toner particle does not slip through; FIG. 9B is a graph showing a limit area that the spherical toner particle slips through, when θ=15'; FIG. 9C is a graph showing a limit area that the spherical toner particle slips through, when θ=30'; and FIG. 9D is a graph showing a limit area that the spherical toner slips through, when θ=45°.

DETAILED DESCRIPTION OF THE PREFERRED EMBODIMENTS

A cleaning apparatus of an embodiment of the present invention has a blade to remove toner remaining on a photosensitive body in an electrophotographic type image forming apparatus. A front end of the blade is arranged on the photosensitive body so as to satisfy a condition of formula (1) below.

[Formula 1]

$$\mu \leq \frac{\sin\theta}{1+\cos\theta} \tag{1}$$

Here, when a sphere having a diameter of (D−σ) contacts a surface of the photosensitive body and the blade at the same time, θ is an angle defined by a tangent line 1 at a contact point between the sphere and the surface of the photosensitive body and a tangent line 2 at a contact point between the sphere and the blade, with the sphere sandwiched between the tangent lines 1 and 2. D and σ are a mean particle diameter and a standard deviation of a particle size distribution of toner particles of the toner, respectively. In the formula (1), μ is a friction coefficient that is the smaller of a friction coefficient $\mu_1$ between the toner and the surface of the photosensitive body and a friction coefficient $\mu_2$ between the toner and the blade. The friction coefficients μ, $\mu_1$, and $\mu_2$ are sliding friction coefficients.

That is, when a predetermined photosensitive body and a predetermined blade of the cleaning apparatus are used, and a mean particle diameter and a standard deviation of a particle size distribution of the toner particles are determined, an arrangement of the blade with respect to the surface of the photosensitive body can be easily specified. In general, a photosensitive body and a blade of a cleaning apparatus are used over a long duration, and toner having specific characteristics such as a mean particle diameter and a standard deviation of a particle size distribution is used as a genuine product. Therefore, once the arrangement of the blade with respect to the surface of the photosensitive body is determined, the arrangement is not required to be changed. Further, when the characteristics of the toner are changed, an angle θ is to be calculated by formula (1), and the blade may be arranged according to the obtained angle θ. In this manner, toner remaining on the photosensitive body is easily removed.

Figure 1:
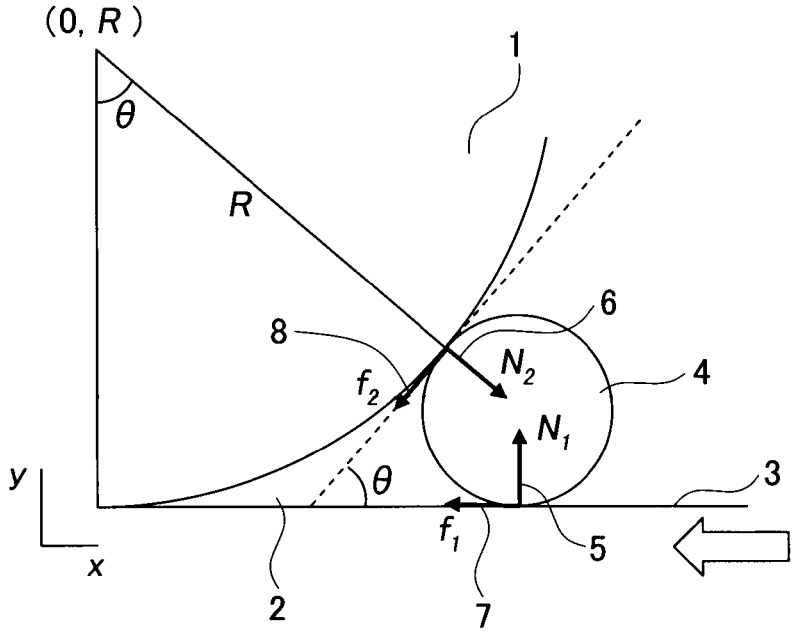
FIG. 1 is a diagram showing a relationship between a toner particle and a front end part of a blade of a cleaning apparatus according to an embodiment of the present invention.

Formula (1) of the cleaning apparatus of an embodiment of the present invention is described with reference to FIG. 1. FIG. 1 is an enlarged view showing the vicinity of a front end part of a blade, in which a spherical toner particle with a radius of r contacts a surface of a photosensitive body and the front end part of the blade at the same time. To simplify the drawing, the surface of the photosensitive body is drawn plane. The front end part of the blade has a cylindrical shape with a curvature radius of R between contact points with the surface of the photosensitive body and the spherical toner particle (a circular cross-section of the front end of the blade is shown in a cross-sectional view of FIG. 1).

The surface of the photosensitive body moves from right to left in FIG. 1 by rotation. Therefore, a force to go into a wedge-shaped space under the blade is applied to the spherical toner particle adhering on the surface of the photosensitive body. A normal force $N_1$ and a tangential force $f_1$ are applied at a contact point between the spherical toner particle and the surface of the photosensitive body, while a normal force $N_2$ and a tangential force $f_2$ are applied at a contact point between the spherical toner particle and the blade. Directions of arrows indicating these forces in FIG. 1 are forward directions. A slope angle defined by a tangent line at a contact point between the spherical toner particle and the blade and the surface of the photosensitive body, sandwiching the spherical toner particle, is θ. In this case, equations of motion of the spherical toner particle are as expressed in the following formulas (2) through (4).

[Formulas 2 through 4]

$$m\ddot{x}=N_2 \sin\theta-f_1-f_2\cos\theta \quad (2)$$

$$m\ddot{y}=N_1-N_2\cos\theta-f_2\sin\theta \quad (3)$$

$$I\dot{\omega}=r(f_2-f_1) \quad (4)$$

Coordinates (x and y) are position coordinates of a center of the spherical toner particle, m denotes a toner particle mass, I denotes an inertia moment of the spherical toner particle, and ω denotes a rotational angular speed of the spherical toner particle. Further, since gravity applied to the spherical toner particle is small, it is ignored here. In formulas (2) through (4), θ is a slope angle (nip angle) of a contact surface between the spherical toner particle and the blade when the spherical toner particle slips under the blade, with $\theta_0$ used as an initial value.

As shown in FIG. 1, when the front end part of the blade has a cylindrical shape with a curvature radius of R between the contact points with the surface of the photosensitive body and the spherical toner particle, an initial contact angle (initial nip angle) $\theta_0$ is expressed by the following formula (5).

[Formula 5]

$$\cos\theta_0=\frac{R-r}{R+r} \quad (5)$$

In formula (5), r denotes the radius of the toner particle.

In formulas (2) through (4), $f_1$ and $f_2$ denote friction forces at a contact point between the toner particle and the blade and a contact point between the toner particle and the surface of the photosensitive body, respectively. Therefore, the formulas (2) through (4) are expressed by the following formulas (6) through (8).

[Formulas 6 to 8]

$$m\ddot{x}=N_2\sin\theta-\mu_1N_1-\mu_2N_2\cos\theta \quad (6)$$

$$m\ddot{y}=N_1-N_2\cos\theta-\mu_2N_2\sin\theta \quad (7)$$

$$I\dot{\omega}=r(\mu_2N_2-\mu_1N_1) \quad (8)$$

Note that $\mu_1$ denotes a sliding friction coefficient between the spherical toner particle and the surface of the photosensitive body, while $\mu_2$ denotes a sliding friction coefficient between the spherical toner particle and the blade.

Here, when slipping is caused at the contact point between the spherical toner particle and the blade in accordance with the rotation of the photosensitive body, the spherical toner particle rolls at that point and cannot enter the space between the blade and the surface of the photosensitive body. When slipping is caused at the contact point between the spherical toner particle and the surface of the photosensitive body, the toner particle does not roll and stays stationary. When slipping is not caused at either of the contact points, the toner particle rolls into the wedge-shaped space, and slips through the wedge-shaped space. At this time, the front end part of the blade, which is formed of rubber, is deformed when the toner particle is in the wedge-shaped space.

In view of this, conditions under which the spherical toner particle does not slip through the wedge-shaped space are obtained by the equations of motion, of the formulas (6) through (8). In FIG. 1, the forces to sandwich the spherical toner particle at the contact points are balanced. Thus, the normal forces $N_1$ and $N_2$ are almost the same ($N_1=N_2=N$). When the friction coefficients $\mu_1$ and $\mu_2$ are equal to each other ($\mu_1=\mu_2=\mu$), a force applied to the toner particle in an x-direction, which is expressed by formula (6), is expressed by the following formula (9).

[Formula 9]

$$m\ddot{x}=N\sin\theta-\mu N-\mu N\cos\theta \quad (9)$$

To prevent formula (9) from yielding a negative value, that is, to prevent acceleration in a left direction, that is a negative direction on the x-axis in FIG. 1, from being applied to the spherical toner particle, a condition expressed by the following formula (10), which is the same as formula (1), is required.

[Formula 10]

$$\mu\le\frac{\sin\theta}{1+\cos\theta} \quad (10)$$

When the acceleration in the left direction is not applied to the spherical toner particle, the spherical toner particle does not slip through the wedge-shaped space. That is, by formula (10), a relationship of θ with respect to the friction coefficient μ, to prevent the spherical toner particle from slipping through the wedge-shaped space, can be obtained. The right-hand side of formula (10) corresponds to a monotonously increasing function of θ. Therefore, in the case where formula (10) is not satisfied when $\theta=\theta_0$ (initial contact), formula (10) is not satisfied when $\theta<\theta_0$ thereafter. As a result, the spherical toner particle slips through the wedge-shaped space. On the contrary, in the case where formula (10) is satisfied when $\theta=\theta_0$, the toner particle does not start entering the wedge-shaped space. Therefore, the following formula (11) is a condition at the initial contact to prevent the spherical toner particle from slipping through the wedge-shaped space.

[Formula 11]

$$\mu \leq \frac{\sin\theta_0}{1+\cos\theta_0} \tag{11}$$

Although $\mu_1=\mu_2=\mu$ in formula (9) according to formula (6), when $\mu_1$ and $\mu_2$ are different from each other, a smaller one between $\mu_1$ and $\mu_2$ may be used as $\mu$. Since $\theta$ is less than 90°, N and N cos $\theta$ are both positive, and ($\mu N+\mu N \cos\theta$) becomes smaller than ($\mu_1 N+\mu_2 N \cos\theta$). Thus, the value obtained by formula (9) becomes larger than the value obtained by formula (6). That is, the spherical toner particle does not slip through the wedge-shaped space when one of the friction coefficient $\mu_1$ between the spherical toner particle and the surface of the photosensitive body and the friction coefficient $\mu_2$ between the spherical toner particle and the blade satisfies formula (11).

When the relationship of formula (5) is substituted in formula (11), formula (12) is obtained.

[Formula 12]

$$\mu \leq \sqrt{\frac{r}{R}} \tag{12}$$

This condition prevents the spherical toner particle from slipping through the wedge-shaped space, in the case where the shape and arrangement of the front end part of the blade are such that the front end part of the blade has a cylindrical shape with a curvature radius of R between contact points with the surface of the photosensitive body and the spherical toner particle as shown in FIG. 1.

Ideally, in a phenomenon of the spherical toner particle slipping through the space between the surface of the photosensitive body and the front end part of the blade, the spherical toner particle, having the friction forces applied at the contact parts with the surface of the photosensitive body and the blade, rolls and squeezes under the blade so as not to generate slipping at either of the contact points. In this case, the front end part of the blade is pressed by the toner particle and deformed.

Figure 8:
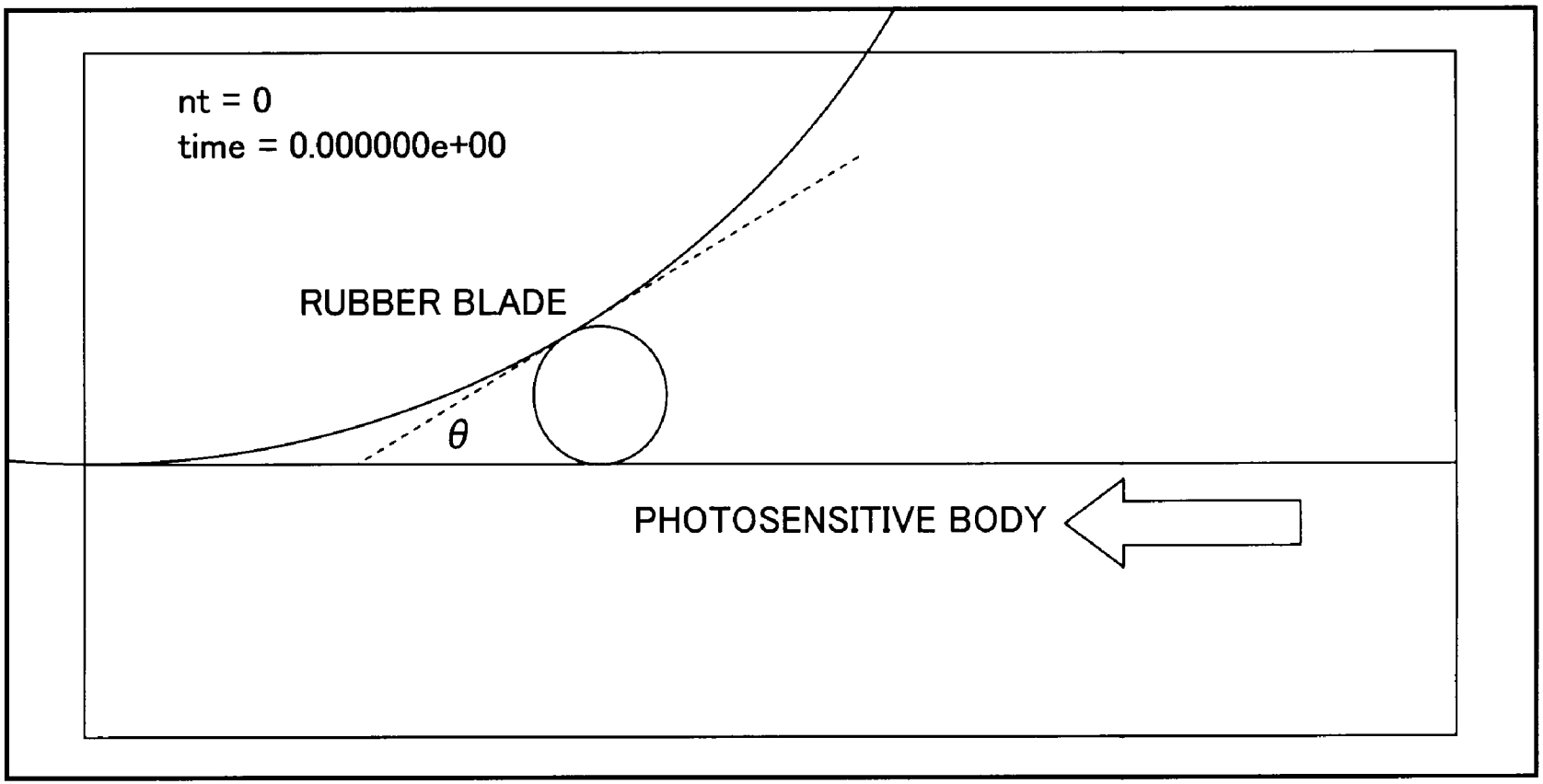
FIG. 8 is a diagram showing a simulation of a toner particle slipping through, of a cleaning apparatus according to an embodiment of the present invention.

The phenomenon of the spherical toner particle slipping through the space has been analytically described above. This phenomenon is confirmed by a numerical simulation as well. FIGS. 8 and 9 show examples of calculating the behavior of the spherical toner particle slipping into the space between the blade and the photosensitive body, by using a behavioral analysis method of powder particles, which is called a distinct element method (DEM).

FIG. 8 is a calculation model diagram corresponding to FIG. 1. With respect to the angles $\theta$=15°, 30°, and 45°, at which the blade and the photosensitive body sandwich the spherical toner particle as shown in FIG. 1, the friction coefficient $\mu_1$ between the spherical toner particle and the surface of the photosensitive body, and the friction coefficient $\mu_2$ between the spherical toner particle and the blade are changed to perform calculations.

Figures 9A, 9B:
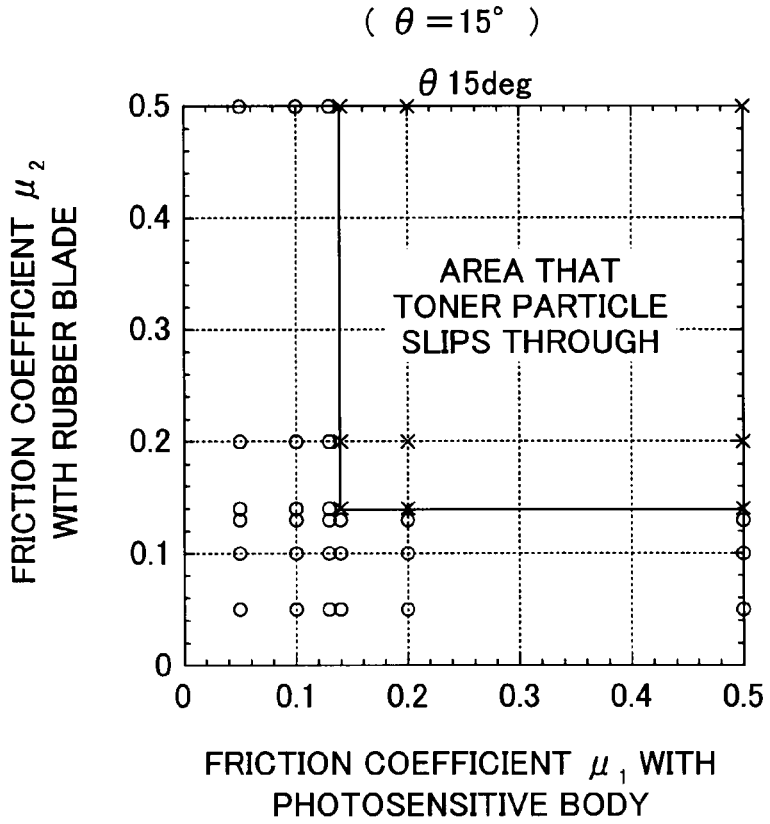
FIGS. 9A through 9D are diagrams showing simulations of toner particles slipping through, of a cleaning apparatus according to an embodiment of the present invention, where
Figure 9C:
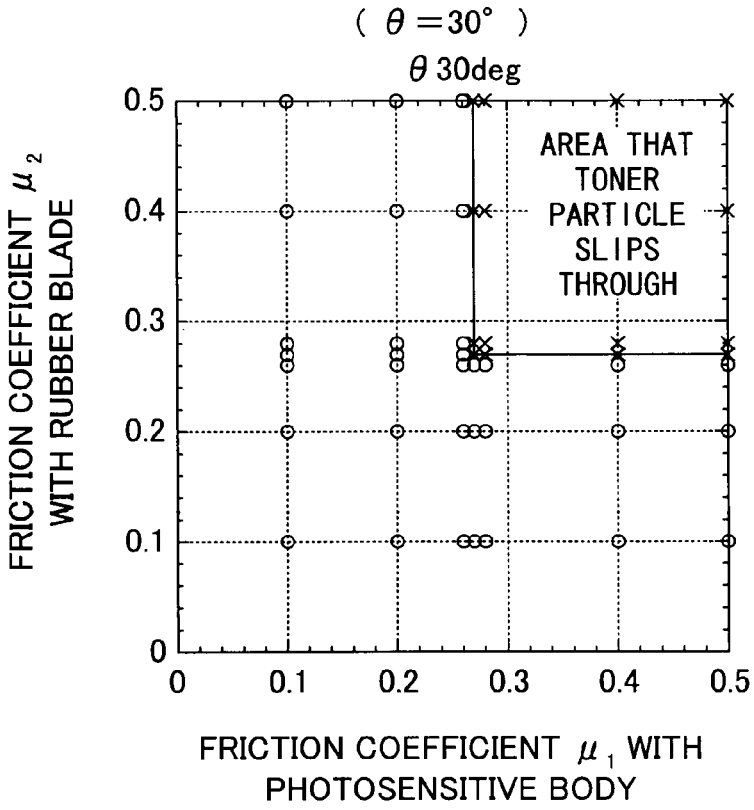
Figure 9D:
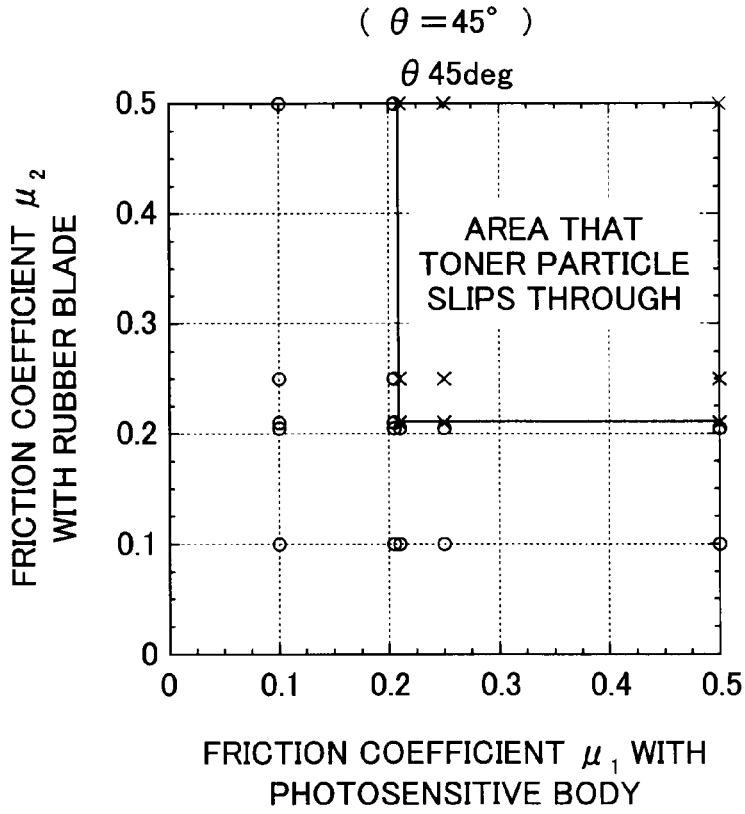

FIG. 9A shows results of calculating limiting maximum friction coefficients, with which the spherical toner particle does not slip through between the blade and the surface of the photosensitive body, when $\theta$=15°, 30°, and 45°. These friction coefficients are calculated by analyses using formula (1) of the present invention and numerical simulation by the DEM. The limiting maximum friction coefficient with which the spherical toner particle does not slip through the space between the blade and the surface of the photosensitive body is expressed as $\mu_c$. When $\theta$=15°, 30°, and 45°, $\mu_c$=0.13, 0.26, and 0.41 are calculated, respectively. FIGS. 9B, 9C, and 9D are graphs showing limit areas in which the spherical toner particles slip through, with respect to $\mu_1$ and $\mu_2$, from the results of the numerical simulation. As shown in FIGS. 9A, 9B, 9C, and 9D, the spherical toner particle does not slip through the space between the blade and the surface of the photosensitive body when $\mu \leqq \mu_c$. Here, a smaller friction coefficient between $\mu_1$ and $\mu_2$ corresponds to $\mu$. Further, the values of $\mu_c$, which are obtained by the numerical simulations when $\theta$=15°, 30°, and 45°, match the values obtained by formula (1) in which $\theta$=15°, 30°, and 45° are substituted, within 1%. The phenomenon of the spherical toner particle slipping through the space between the blade and the surface of the photosensitive body, which is described in the embodiment of the present invention, is confirmed by the results of the numeral simulations as well. Thus, the condition to prevent the spherical toner particle from slipping through the space between the blade and the surface of the photosensitive body is expressed by formula (1).

When the friction coefficient between the spherical toner particle and the surface of the photosensitive body is small, slipping is caused at the contact point between the spherical toner particle and the surface of the photosensitive body. Thus, the spherical toner particle does not slip through the space between the surface of the photosensitive body and the blade. When the friction coefficient between the spherical toner particle and the blade is small, the spherical toner particle rolls and slipping is caused at the contact point between the spherical toner particle and the blade. Thus, the spherical toner particle rolls at this point and does not slip through the space between the blade and the surface of the photosensitive body.

There are variations in particle diameters and shapes in actual toner particles. When a particle diameter of a toner particle to be removed is D, and selections are made so that the spherical toner with the diameter of D satisfies formula (11), the spherical toner particle does not slip through the space between the blade and the surface of the photosensitive body. When the particle size distribution of the toner is a Gaussian distribution with a mean particle diameter of $D_0$ and a standard deviation of $\sigma$, 84.1% or more of the toner particles have a particle diameter of ($D_0-\sigma$). For example, when the particle size distribution of the toner is $\sigma$=about $0.2D_0$, D is obtained in this manner: $D=D_0-\sigma=0.8D_0$. When D obtained in this manner is substituted in the formula (11), 84.1% or more of the remaining toner particles can be removed. Further, 97.7% or more of the toner particles have a particle diameter of ($D_0-2\sigma$) or more. In a similar manner to the above description, D is obtained in this manner: $D=D_0-2\sigma=0.6D_0$. By substituting D obtained in this manner in the formula (11), 97.7% or more of the remaining toner particles can be removed.

In this manner, in an embodiment of the present invention, the degree of completeness of removing the remaining toner can be controlled by selecting toner with D smaller than $D_0$. When there is little remaining toner to be removed and the quality of a formed image is not affected much, it is enough to remove 84% of the remaining toner. Thus, $D=(D_0-\sigma)$ is to be selected. When there is relatively much remaining toner to be removed and an image with high quality is to be obtained, it is preferable to select $D=(D_0-2\sigma)$ and further $D=(D_0-3\sigma)$ in order to remove the remaining toner sufficiently.

Embodiments of the present invention are described with reference to the drawings. It is easy for those skilled in the art to modify and change the embodiments of the present invention to make another embodiment without departing from the scope of the present invention. Accordingly, all such modifications are intended to be included within the scope of present invention. The following descriptions are examples of preferred embodiments of the present invention and do not limit the scope of the present invention.

EMBODIMENT 1

FIG. 1 shows the vicinity of a front end part of a blade of a cleaning apparatus of embodiment 1 of the present invention. FIG. 1 shows a remaining toner particle adhering on a photosensitive body contacting the vicinity of the front end part of the blade of the cleaning apparatus of the present embodiment. The cleaning apparatus of the present embodiment is provided on the photosensitive body. In FIG. 1, reference numeral 1 denotes a blade, 2 denotes a space between a surface of the photosensitive body (photosensitive body surface) and the blade 1, 3 denotes the photosensitive body surface, 4 denotes a toner particle (with a radius of r), 5 denotes a normal force $N_1$ applied at a contact point between the toner particle 4 and the photosensitive body surface 3, 6 denotes a normal force $N_2$ applied at a contact point between the toner particle 4 and the blade 1, 7 denotes a friction force $f_1$ applied at the contact point between the toner particle 4 and the photosensitive body surface 3, and 8 denotes a friction force $f_2$ applied at the contact point between the toner particle 4 and the blade 1.

The front end part of the blade 1 of the cleaning apparatus of embodiment 1 is a part of a cylindrical shape. Since FIG. 1 is a cross-sectional view, the front end of the blade 1 having a circular shape is arranged so as to contact the photosensitive body surface 3. The remaining toner particle 4 adhering on the photosensitive body surface 3 also contacts the front end part of the circular shape of the blade 1. As shown in FIG. 1, an angle $\theta$, defined by a tangent line between the toner particle 4 and the photosensitive body surface 3 and a tangent line between the toner particle 4 and the blade 1 so as to sandwich the toner particle 4, equals an angle defined by a contact point between the blade 1 and the photosensitive body surface 3 and a contact point between the blade 1 and the toner particle 4, when seen from a curvature center point (0, R) of the circular shape of the front end part of the blade 1.

Here, as described above, the cleaning apparatus of the present invention can be formed by setting the friction coefficient $\mu$ (the smaller friction coefficient of the friction coefficient $\mu_1$ between the toner particle 4 and the photosensitive body surface 3 and the friction coefficient $\mu_2$ between the toner particle 4 and the blade 1), the curvature radius R of the circular shape of the front end part of the blade 1, and the radius r of the toner particle 4 to satisfy formula (12). By using a given photosensitive body and a given toner particle as the photosensitive body 3 and the toner particle 4, the curvature radius R of the circular shape of the front end part of the blade 1 may satisfy the formula (12). Further, when a given photosensitive body and a given blade are used as the photosensitive body 3 and the blade 1, the toner particle 4 is to be selected so that the radius r satisfies the formula (12). As described above, the radius r of the toner particle 4 is $\{(D-\sigma)/2\}$ when the mean particle diameter of the toner particle 4 is D. Here, $\sigma$ is a standard deviation of a particle diameter distribution of the toner particle 4.

Figure 7:
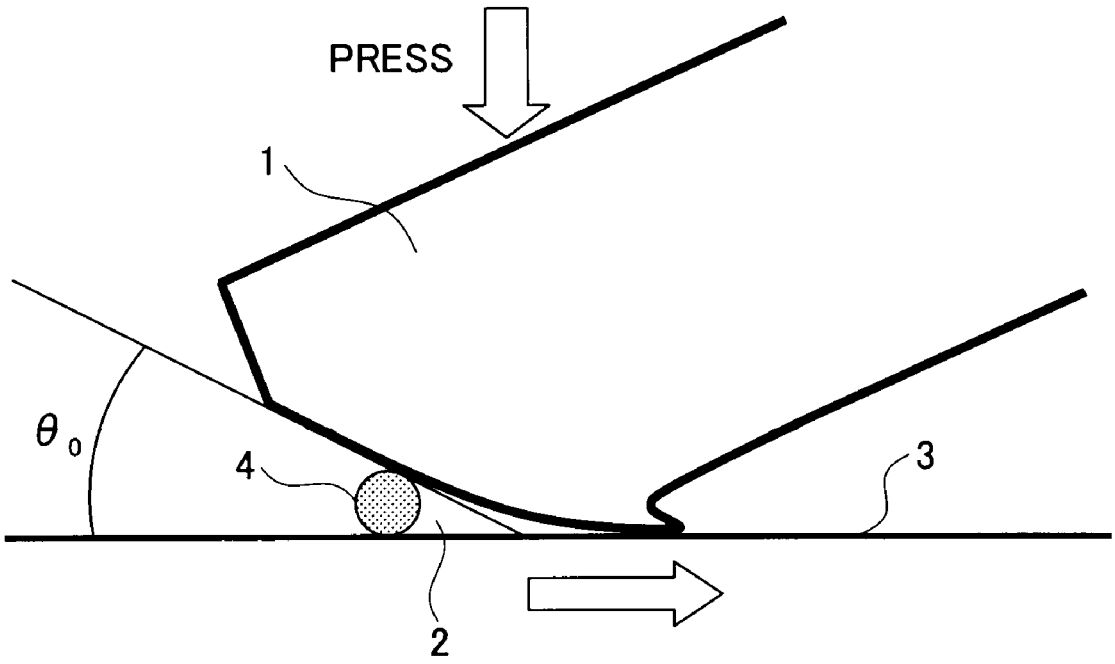
FIG. 7 is an enlarged view of a front end part of a blade of a conventional cleaning apparatus.

For example, in the case where the radius r of the toner particle 4 is 5 μm and a friction coefficient of the photosensitive body surface 3 is 0.1, the toner particle 4 does not slip through the space 2 when the curvature radius R of the blade 1 is less than 0.5 mm, according to formula (12). Since a conventional blade 1 is arranged as shown in FIG. 7, an edge of the blade 1 is dragged in the rotation direction of the photosensitive body. Thus, the curvature radius of a front end part of the blade 1 is much larger.

EMBODIMENT 2

Figure 2:
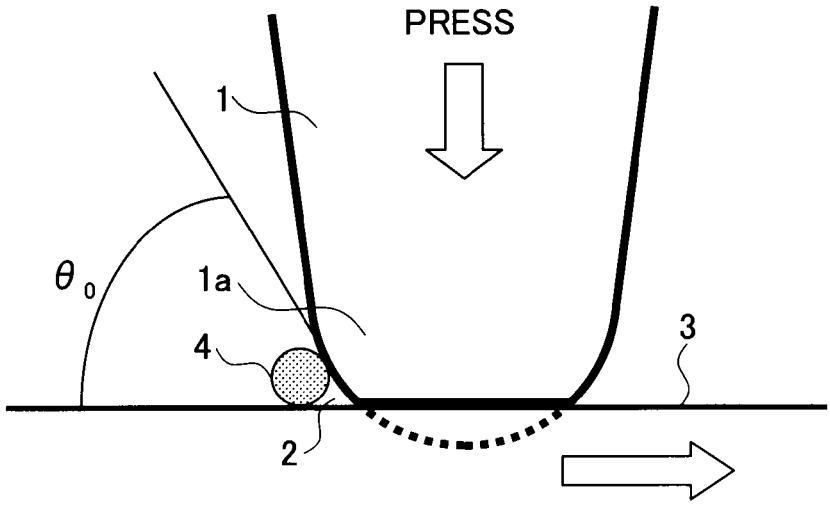
FIG. 2 is an enlarged view of a front end part of a blade of a cleaning apparatus according to an embodiment of the present invention.

FIG. 2 shows a front end part of a blade of a cleaning apparatus of an embodiment 2 of the present invention. FIG. 2 shows the remaining toner particle 4 adhering on the photosensitive body contacting the vicinity of a front end part 1*a* of the blade of the cleaning apparatus of the present invention, which is provided on the photosensitive body. The front end part 1*a* of the blade of the cleaning apparatus of the embodiment 2 has a substantially semi-cylindrical shape. Since the blade 1 is pressed onto the photosensitive body surface 3, a leading edge part of the semi-cylindrical shape of the blade 1 is deformed to be substantially flat in the same shape as the photosensitive body surface 3.

As shown in FIG. 2, when the front end part 1*a* of the blade is in a semi-cylindrical shape and the blade has such a shape that a nip angle $\theta_0$ defined with the photosensitive body surface 3 becomes larger, a value of the right hand side of formula (11) becomes larger and formula (11) can be satisfied. By pressing the blade 1 onto the photosensitive body surface 3, the angle $\theta_0$ becomes larger. However, when the pressing force becomes larger, more load is applied to driving the photosensitive body. Therefore, it is preferable to control and apply a minute pressing force to the blade 1 so as to satisfy formula (11). Alternatively, a friction force between the blade 1 and the photosensitive body surface 3 may be reduced by using silica fine particles as a lubricant, so that the nip angle $\theta_0$ satisfies the formula (11).

EMBODIMENT 3

The appearance of a cleaning apparatus of embodiment 3 of the present invention is the same as the cleaning apparatus described in embodiment 2. In the cleaning apparatus of embodiment 3, a surface of the front end part 1*a* of the blade 1 is covered with a material having a small friction coefficient with the toner particle 4. Normally, a relationship between the friction coefficient $\mu_1$ between the toner particle 4 and the photosensitive body surface 3 and the friction coefficient $\mu_2$ between the toner particle 4 and the front end part 1*a* of the blade 1 is $\mu_1<\mu_2$, since the blade 1 is formed of rubber. By covering the surface of the front end part 1*a* of the blade 1 with the material having a small friction coefficient with the toner particle 4 so that $\mu_2<\mu_1$, formula (11) can be satisfied since $\mu=\mu_2$. As a result, the friction coefficient $\mu_2$ of the material of the surface of the blade 1 is not required to be taken into consideration. The degree of freedom to select $\mu_1$ is increased as well.

EMBODIMENT 4

Figure 3:
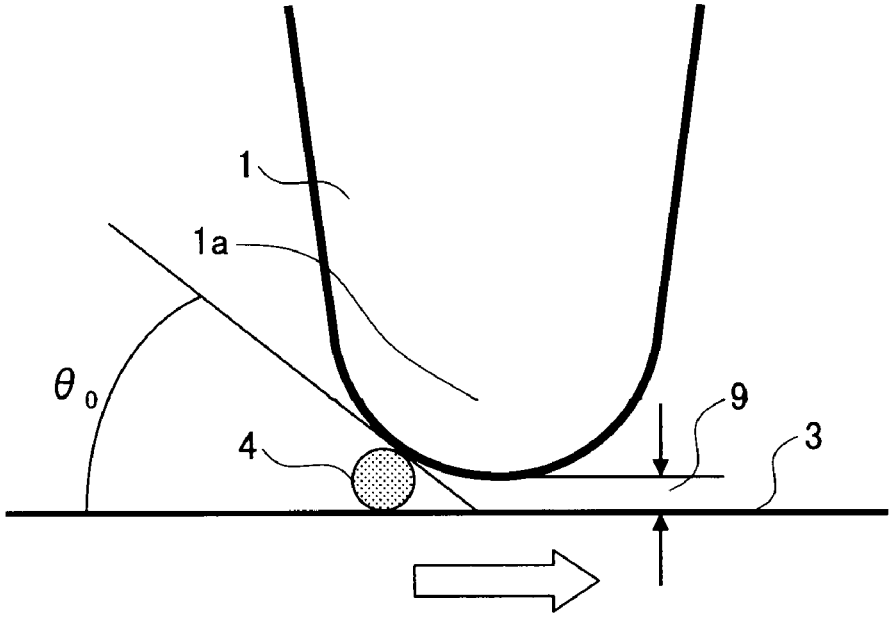
FIG. 3 is an enlarged view of a front end part of a blade of a cleaning apparatus according to an embodiment of the present invention.

FIG. 3 shows a front end part of a blade of a cleaning apparatus of embodiment 4 of the present invention. FIG. 3 shows the remaining toner particle 4 adhering on the photosensitive body contacting the vicinity of the front end part 1*a* of the blade of the cleaning apparatus of the present embodiment, which is provided over the photosensitive body. The cleaning apparatus of embodiment 4 is different from the cleaning apparatus of embodiment 2, in that the front end part 1*a* of the blade does not contact the photosensitive body surface 3. However, a gap 9 between the front end part 1*a* of the blade and the photosensitive body surface 3 is smaller than the diameter of the toner particle 4. The diameter of the toner particle 4 may be (D−σ) which is described above.

In this manner, even when the blade 1 and the photosensitive body surface 3 do not contact each other, formula (11) can be satisfied. The front end part 1*a* of the blade as described in embodiment 4 may be covered with a constant friction material.

EMBODIMENT 5

Figure 4:
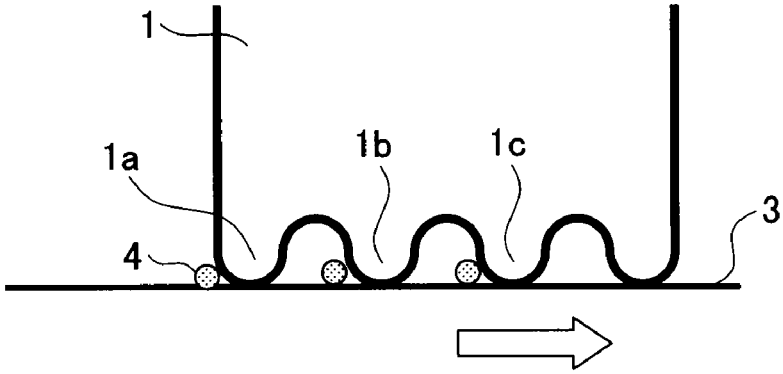
FIG. 4 is an enlarged view of a front end part of a blade of a cleaning apparatus according to an embodiment of the present invention.

FIG. 4 shows a front end part of a blade of a cleaning apparatus of embodiment 5 of the present invention. FIG. 4 shows the remaining toner particle 4 adhering on the photosensitive body contacting the vicinity of the front end part 1*a* of the blade 1 of the cleaning apparatus of the present embodiment, which is provided on the photosensitive body. The cleaning apparatus of this embodiment is different from the cleaning apparatus of embodiment 2, in that the front end part 1*a* of the blade 1 has plural protruding parts. Protruding parts 1*a*, 1*b*, and 1*c*, . . . are each arranged so as to satisfy the relationship of formula (11). In this case, the respective protruding parts may contact the photosensitive body surface 3 or not as long as the respective protruding parts satisfy formula (11). In the cleaning apparatus of this embodiment, the protruding parts 1*a*, 1*b*, and 1*c*, . . . can remove the toner particles remaining on the photosensitive body surface, and have the same effect as performing plural cleanings by plural blades.

When the blade 1 with the semi-cylindrical shape is used as those of the cleaning apparatuses of the embodiments 1 through 4, the curvature radius R of the front end part 1*a* of the blade 1 has to be made small in many cases to satisfy formula (11). However, in that case, it is difficult to realize a uniform non-contact state or a minutely pressed state in a width direction of the photosensitive body (a direction vertical to a moving direction of the photosensitive body surface) in view of the configuration of the actual components. Thus, variations are caused in the width direction of the photosensitive body. As a result, there are local areas where toner particles cannot be prevented from slipping through between the blade and the photosensitive body surface. In view of this, as shown in FIG. 4, the blade 1 having the plural protruding parts is used so that curvature radiuses of the protruding parts and depressed parts of contact areas satisfy formula (12) or (11). As a result, cleaning in multiple stages by using the blade can be realized. By using a blade in such a shape, a spherical toner particle slipping through a first protruding part by disturbance and the like is trapped by a subsequent protruding part.

Among the plural protruding parts, the protruding part 1*a* to remove the toner particle 4 first may be able to remove a toner particle having a particle diameter of (D−σ) and greater, the next protruding part 1*b* may be able to remove a toner particle having a particle diameter of (D−2σ) and greater, and the further next protruding part 1*c* may be able to remove a toner particle having a particle diameter of (D−3σ) and greater. In this manner, loads of removing the toner particles, of the protruding parts 1*a*, 1*b*, and 1*c*, . . . of the blade 1 can be made uniform.

Further, among the plural protruding parts 1*a*, 1*b*, and 1*c*, . . . of the blade 1, the blade 1 may be arranged so that only the protruding part 1*a* can effectively remove the toner particles. When a toner removal effect of the protruding part 1*a* is reduced by fatigue and the like, the blade 1 is arranged so that the protruding part 1*b* can effectively remove the toner particles. When a toner removal effect of the protruding part 1*b* is reduced by fatigue and the like, the blade 1 is arranged so that the protruding part 1*c* can effectively remove the toner particles. The cleaning apparatus of this embodiment may be used in this manner. In this case, it is more preferable to arrange the plural protruding parts 1*a*, 1*b*, and 1*c*, . . . over a base substrate on a curved surface, than on a plane surface at a front end of the blade 1.

EMBODIMENT 6

Figure 5:
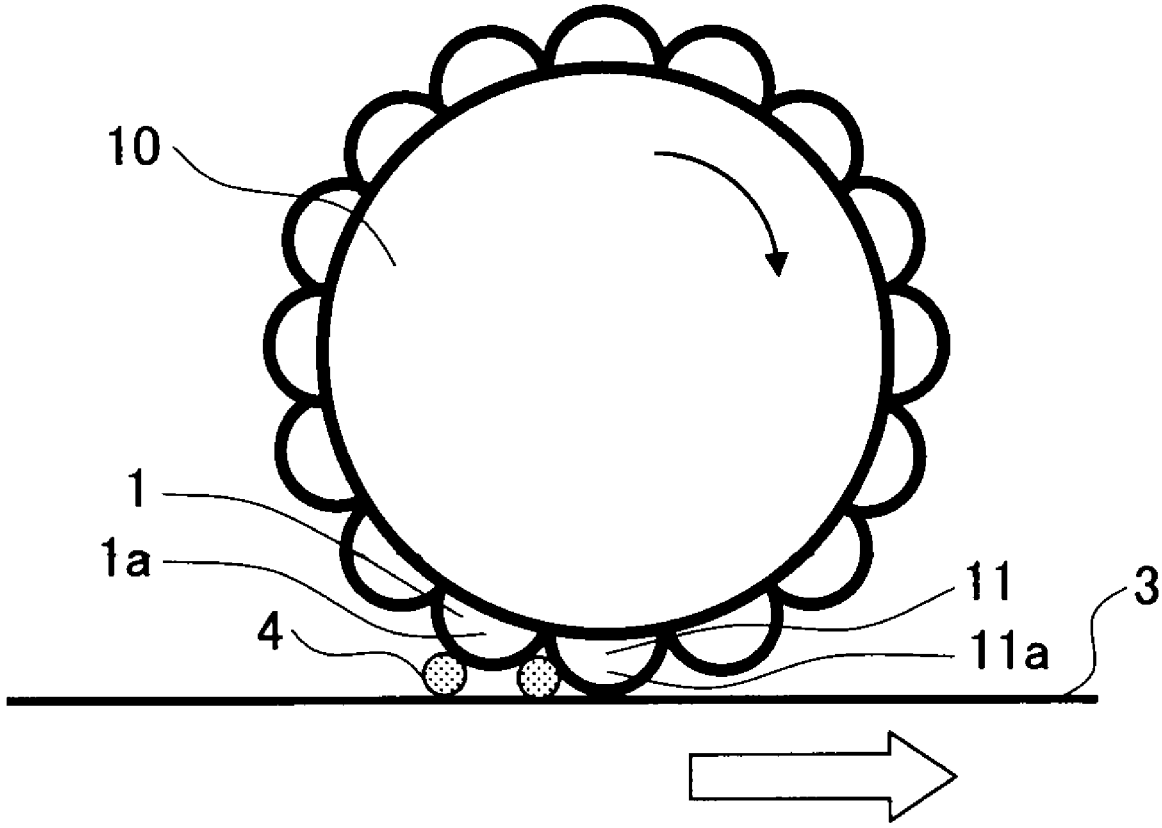
FIG. 5 is a diagram showing a cleaning apparatus according to an embodiment of the present invention.

FIG. 5 shows a front end part of a blade of a cleaning apparatus of embodiment 6 of the present invention. FIG. 5 shows the blade 1 of the cleaning apparatus of the present embodiment, which is provided on the photosensitive body, contacting the remaining toner particles 4 adhering on the photosensitive body.

In the cleaning apparatus of this embodiment, the plural blades 1 are arranged on a surface of a base substrate 10 in a cylindrical shape. A front end part of at least one of the blades 1, 11, and the like is arranged with respect to the photosensitive body surface 3 so as to satisfy formula (11) or (12). In FIG. 5, the blades 1 and 11 satisfy formula (12). Therefore, the toner particles 4 are removed by the blades 1 and 11. When the blades 1 and 11 are deteriorated due to use over a long duration, the base substrate 10 is rotated to arrange another blade with respect to the photosensitive body surface 3 so as to satisfy formula (11) or (12). In this manner, the service life of the cleaning apparatus can be drastically extended. In the cleaning apparatus of this embodiment, it is also effective to cover the surface of the blade.

In the above description of the cleaning apparatuses of embodiments of the present invention, it has also been described that a cleaning method of the present invention can be achieved by selecting a material and arrangement of the blade, toner particles, and the like. In some cases, the cleaning method of the present invention can be achieved by selecting a material of the photosensitive body surface.

EMBODIMENT 7

Figure 6:
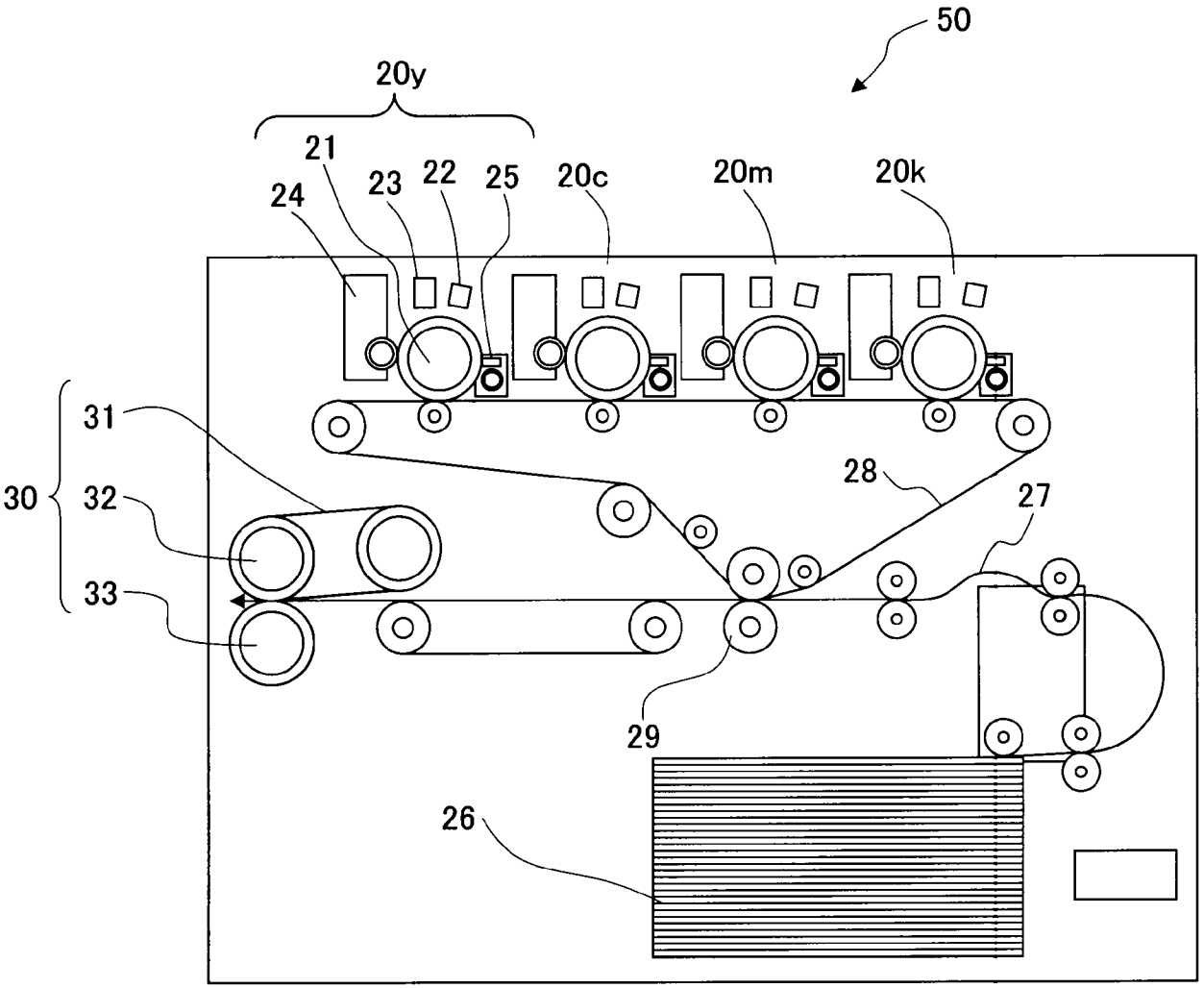
FIG. 6 is an image forming apparatus according to an embodiment of the present invention.

FIG. 6 shows an example of an image forming apparatus of embodiment 7 of the present invention. This image forming apparatus is a full color image forming apparatus. The configuration of this image forming apparatus is similar to that of a conventional electrophotographic type image forming apparatus. A feature of the image forming apparatus of embodiment 7 of the present invention is that the cleaning apparatus is used as a cleaning apparatus for a photosensitive body. In an image forming apparatus 50 shown in FIG. 6, four image forming units 20*y*, 20*c*, 20*m*, and 20*k* are provided, each having a cleaning apparatus of an embodiment of the present invention. The cleaning apparatus of the embodiments of the present invention may be used only for the image forming unit 20*k*, which is most frequently used and a stain of whose toner is noticeable. However, it is preferable to provide a cleaning apparatus of the embodiments of the present invention for the respective image forming units to obtain a high quality image.

The image forming apparatus 50 of this embodiment includes a paper feed unit 26, the image forming units 20*y*, 20*c*, 20*m*, and 20*k*, a transfer belt 28 onto which images formed by the image forming units 20*y*, 20*c*, 20*m*, and 20*k* are transferred, a transfer roller 29 to transfer the image from the transfer belt 28 onto recording paper 27, and a fixing apparatus 30 to fix the transferred image on the recording paper 27.

Each of the image forming units includes, for example, the image forming unit 20$y$ that includes a photosensitive body 21, a charging apparatus 22, a latent image forming apparatus 23, a developing apparatus 24, and a cleaning apparatus 25 of embodiments of the present invention.

EMBODIMENT 8

According to embodiment 8 of the present invention, a process cartridge is provided. The process cartridge of embodiment 8 is formed of one of the image forming units 20$y$, 20$c$, 20$m$, and 20$k$. For example, the process cartridge of embodiment 8 is formed of the image forming unit 20$y$ in which the latent image forming apparatus 23 is removed. In the process cartridge of the embodiment of the present invention, the photosensitive body 21 and the cleaning apparatus 25 are included in the configuration. Other components and apparatuses are optional; however, the developing apparatus is preferably included.

The cleaning apparatus, the image forming apparatus, the process cartridge, and the cleaning method of the present invention are effective for electrophotographic type printing machines and multifunction peripherals that are capable of continuously forming images. In particular, the cleaning apparatus, the image forming apparatus, the process cartridge, and the cleaning method of the present invention are favorably used in the case where images with high quality and reliability are required to be formed at a high speed for a certain period of time, such as in a high speed large-size continuous printing machine.

According to one embodiment, a cleaning apparatus having a blade capable of effectively removing toner particles, including even a spherical toner particle, remaining on a surface of a photosensitive body; an image forming apparatus using the cleaning apparatus; and a process cartridge for an image forming apparatus, can be provided.

This patent application is based on Japanese Priority Patent Application No. 2008-096364 filed on Apr. 2, 2008, and Japanese Priority Patent Application No. 2008-333732 filed on Dec. 26, 2008, the entire contents of which are hereby incorporated herein by reference.

What is claimed is:

1. A cleaning apparatus comprising:

a photosensitive body of an electrophotographic type image forming apparatus, said photosensitive body having a surface; and a blade configured to remove one or more toner particles remaining on the surface of the photosensitive body, wherein said one or more toner particles have a mean particle diameter D and a standard deviation σ of a particle size distribution, and a front end of the blade is arranged on the surface of the photosensitive body so as to satisfy a condition represented as:

$$\mu \leq \frac{\sin\theta}{1+\cos\theta},$$

when an imaginary sphere having a diameter of (D−σ) contacts the surface of the photosensitive body and the blade at the same time, θ is an angle defined by a first tangent line at a contact point between the sphere and the surface of the photosensitive body and a second tangent line at a contact point between the sphere and the blade, with the sphere sandwiched by said first and second tangent lines, μ is a smaller friction coefficient of a friction coefficient between said one or more toner particles and the surface of the photosensitive body and a friction coefficient between said one or more toner particles and the blade, the front end of the blade has plural protruding parts, and the plural protruding parts are arranged so as to remove toner particles starting with a protruding part provided at an upstream side of the cleaning apparatus to a protruding part that removes a particle having a particle diameter of (D−nσ) (with n being an integer).

2. The cleaning apparatus as claimed in claim 1, wherein the front end of the blade is in a semi-cylindrical shape.

3. The cleaning apparatus as claimed in claim 1, wherein a surface of the front end of the blade is covered with a material having a smaller friction coefficient with said one or more toner particles than the friction coefficient between the blade and said one or more toner particles.

4. The cleaning apparatus as claimed in claim 1, wherein the plural protruding parts can be moved relative to the surface of the photosensitive body.

5. A cleaning apparatus comprising:

a photosensitive body of an electrophotographic type image forming apparatus, said photosensitive body having a surface;

a base substrate having a surface and formed in a cylindrical shape which can rotate about a shaft; and plural blades formed over the surface of the base substrate and configured to remove one or more toner particles remaining on the surface of the photosensitive body, wherein said one or more toner particles have a mean particle diameter D and a standard deviation σ of a particle size distribution, one or more front ends of the blades are arranged on the surface of the photosensitive body so as to satisfy a condition represented as:

$$\mu \leq \frac{\sin\theta}{1+\cos\theta},$$

when an imaginary sphere having a diameter of (D−σ) contacts the surface of the photosensitive body and the blade at the same time, θ is an angle defined by a first tangent line at a contact point between the sphere and the surface of the photosensitive body and a second tangent line at a contact point between the sphere and the blade, with the sphere sandwiched by said first and second tangent lines, μ is a smaller friction coefficient of a friction coefficient between said one or more toner particles and the surface of the photosensitive body and a friction coefficient between said one or more toner particles and the blade, one or more front end of the blades have plural protruding parts, and the plural protruding parts are arranged so as to remove toner particles starting with a protruding part provided at an upstream side of the cleaning apparatus to a protruding part that removes a particle having a particle diameter of (D−nσ) (with n being an integer).

6. The cleaning apparatus as claimed in claim 5, wherein said one or more front ends of the blades are in a semi-cylindrical shape.

7. The cleaning apparatus as claimed in claim 5, wherein one or more surfaces of the front ends of the blades are covered with a material having a smaller friction coefficient with said one or more toner particles than the friction coefficient between the blade and said one or more toner particles.

8. An image forming apparatus comprising the cleaning apparatus as claimed in claim 1.

9. A process cartridge for an image forming apparatus, comprising the cleaning apparatus as claimed in claim 1.

10. The cleaning apparatus according to claim 1, wherein the front end of the blade is not in contact with the photosensitive body and a gap between the front end of the blade and the photosensitive body is less than (D−σ).

11. A cleaning apparatus comprising:

a photosensitive body of an electrophotographic type image forming apparatus, said photosensitive body having a surface; and a blade configured to remove one or more toner particles remaining on the surface of the photosensitive body, wherein said one or more toner particles have a mean particle diameter D and a standard deviation σ of a particle size distribution, and a front end of the blade is arranged on the surface of the photosensitive body so as to satisfy a condition represented as:

$$\mu \leq \frac{\sin\theta}{1+\cos\theta},$$

when an imaginary sphere having a diameter of (D−σ) contacts the surface of the photosensitive body and the blade at the same time, θ is an angle defined by a first tangent line at a contact point between the sphere and the surface of the photosensitive body and a second tangent line at a contact point between the sphere and the blade, with the sphere sandwiched by said first and second tangent lines, μ is a smaller friction coefficient of a friction coefficient between said one or more toner particles and the surface of the photosensitive body and a friction coefficient between said one or more toner particles and the blade, and the blade is not in contact with the photosensitive body and a gap between the front end of the blade and the photosensitive body is less than (D−σ).

12. The cleaning apparatus as claimed in claim 11, wherein the front end of the blade is in a semi-cylindrical shape.

13. The cleaning apparatus as claimed in claim 11, wherein a surface of the front end of the blade is covered with a material having a smaller friction coefficient with said one or more toner particles than the friction coefficient between the blade and said one or more toner particles.

14. The cleaning apparatus as claimed in claim 11, wherein the plural protruding parts can be moved relative to the surface of the photosensitive body.

* * * * *